United States Patent [19]

Güell

[11] 4,346,572

[45] Aug. 31, 1982

[54] APPARATUS FOR KNITTING A SINGLE-FACED PILE FABRIC

[75] Inventor: José M. D. Güell, Barcelona, Spain

[73] Assignee: Jumberca, S.A., Badalona, Spain

[21] Appl. No.: 53,273

[22] Filed: Jun. 29, 1979

Related U.S. Application Data

[62] Division of Ser. No. 904,875, May 11, 1978, Pat. No. 4,194,374.

[30] Foreign Application Priority Data

Jun. 3, 1977 [ES] Spain ..... 459450

[51] Int. Cl.[3] ..... D04B 9/12; D04B 15/06

[52] U.S. Cl. ..... 66/93; 66/107; 66/136

[58] Field of Search ..... 66/104, 108 R, 108 A, 66/109, 137 (U.S. only), 83, 9 R, 92, 93, 107, 91, 136

[56] References Cited

U.S. PATENT DOCUMENTS

| | | | |
|---|---|---|---|
| 2,080,377 | 5/1937 | Nebel | 66/93 |
| 2,378,947 | 6/1945 | Page | 66/107 |
| 3,283,542 | 11/1966 | Nebel et al. | 66/108 R |
| 3,406,538 | 10/1968 | Beckenstein | 66/136 X |
| 4,020,653 | 5/1977 | Mishcon et al. | 66/93 |

*Primary Examiner*—Wm. Carter Reynolds
*Attorney, Agent, or Firm*—Staas & Halsey

[57] ABSTRACT

A process for knitting a single-faced pile fabric is disclosed, based on the raising and lowering of conventional needles and the movement of throated sinkers, each sinker having the throat extended and provided with a sloping shoulder in the lower edge thereof, a re-entrant bevel on the upper leading edge, a downwardly extending surface and a notch on the upper edge.

10 Claims, 10 Drawing Figures

APPARATUS FOR KNITTING A SINGLE-FACED PILE FABRIC

This is a division of application Ser. No. 904,875, filed May 11, 1978, now U.S. Pat. No. 4,194,374.

FIELD OF THE INVENTION

The present invention relates to a process for knitting a single-faced pile fabric wherein the stitch forming work of needles in combination with sinkers is facilitated.

SUMMARY OF THE INVENTION

The process is characterised in that the knitting operation is effected with sinkers each having a throat longitudinally extended toward its closed end. A sloping shoulder on a lower edge of the throat and a re-entrant bevel on the leading portion of the upper edge of the throat, all of this supplemented by a notch on the upper edge of the sinker. To develop an operative cycle, starting from a feed stage wherein the sinker is in its position of maximum withdrawal, a base yarn is laid in the sinker throat threshold and a pile yarn is laid over the sinker by a corresponding yarnguide, the sinker is caused to move forwards, thereby aiding a needle latch to introduce the base yarn into the sinker throat with the aid of its leading bevel and cause said yarn to penetrate deeply into the throat, while the pile yarn is placed in the needle hook above the sinker. The needle is then drawn down, starting the sinking of both yarns, while the sinker is caused to push the base yarn with the sloping shoulder into the needle hook, thus ensuring a precise plating relationship between the ground yarn and the pile yarn, by this action the loop formed with the ground yarn occupies a position on the technical face of the fabric burying the ground loop formed with the pile yarn, whereafter the needle is drawn down to its lowermost position and forms a new stitch. Then the needle being raised, at the same time as the sinker is caused to continue its forward movement, thus preventing the previous stitch from being rehooked. Then the sinker being stopped until the needle reaches its uppermost position, thereby stretching the pile stitches at the expense of the corresponding loop by having made them pass over the thickest portion of the needle and the base stitches, having likewise been stretched, being caused to recover their normal length on being pulled by the take-up beam. Then the sinker being made to resume its forward movement, thereby pulling the pile stitch loop, hooked in the upper notch, thereby tightening the pile stitch around the needle stem, and eliminating the stretching. The needle finally being drawn down and the sinker being withdrawn backwards, closing the cycle with knocking off of the pile loops from this sinker.

Further objects and features of the invention will be disclosed in detail throughout the following description, with reference to the accompanying drawings, wherein:

DETAILED DESCRIPTION OF THE INVENTION

Figure 1:
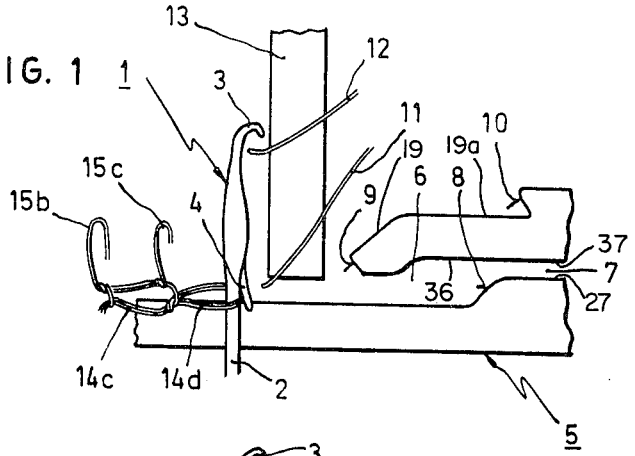
FIGS. 1 to 10 illustrate schematically the successive stages of the movements of a needle and a sinker for knitting the pile fabric according to the process of the invention.

According to the invention, there are used conventional needles 1 having a stem 2, hook 3 and latch 4, and sinkers 5 having a throat 6 with lower edge 26 and upper edge 36 on a circular knitting machine. Special features of the sinker 5 having a belly portion 25 and a nib portion 35 defining upper and lower introduction levels respectfully, are the horizontal extension 7 with lower edge 27 and upper edge 37 for the throat 6, a sloping shoulder 8 on the lower edge of said throat 6 and a bevel 9 on the upper leading edge, supplemented by the notch 10 conventionally located on the upper edge forwardly relative to the closed end of the extension 7 of the throat 6.

The sinker has on the upper forward extremity of the nib 35 a downwardly extending surface 19 to permit reentry of the sinker into previously formed pile loops. The notch 10 associated with the uppermost loop forming surface 19*a* actively engages and fully extends the previously formed pile loops to reform then to uniform heights. The notch 10 is preferably located approximately above the shoulder 8 connecting the lower edge 26 of the throat to the lower edge 27 of the horizontal throat extension.

There is described below the pile fabric knitting process as from the feed stage with the base yarn 11 and pile yarn 12, supplied through a yarn guide 13.

In FIG. 1, the sinker 5 is shown to be in its position of maximum withdrawal, while the needle 1 is at an intermediate height, leaving room for the yarn guide 13 to lay the base yarn 11 in the threshold of the throat 6 and the pile yarn 12 on top of the sinker 5, while the needle drags with it base yarn stitches 14*d*, 14*c*, . . . and pile yarn stitches 15*c*, 15*b*, . . . partly superimposed on the base stitches and partly forming the corresponding loop.

Figure 2:
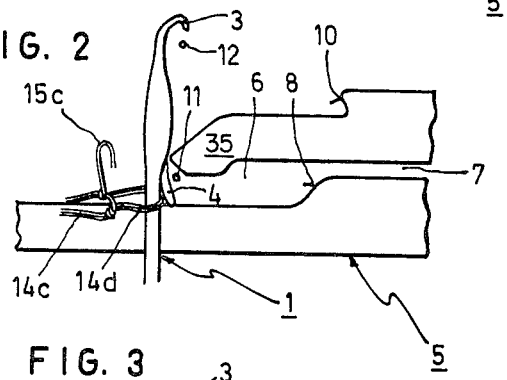

In FIG. 2, the sinker 5 is seen to be moving forward and the base yarn 11, shown in section, as also is yarn 12, is pushed by the latch 4 of the needle 1 to enter the throat 6 with the aid of the front bevel 9 of the sinker.

Figure 3:
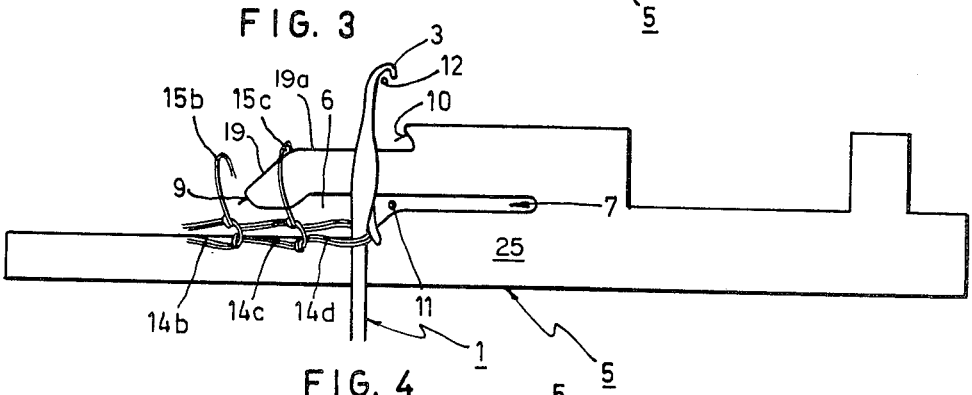

Thereafter, as is seen in FIG. 3, the base yarn 11 (again shown in section) enters the throat 6 of the sinker 5 while the pile yarn 12 is located in the hook 3 of the needle 1, above the sinker.

Figure 4:
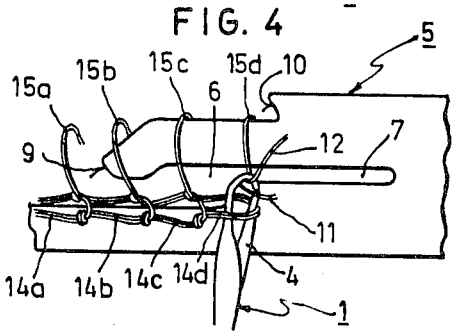

Now, as seen in FIG. 4, the needle is drawn down to start knitting the base yarn 11 and pile yarn 12, while the sinker 5 continues moving forward to push the base yarn 11 into the hook 3 of the needle 1, with the aid of the sloping shoulder 8, to keep it separated from the pile yarn 12, and so be able to control the plating better in this way.

Figure 5:
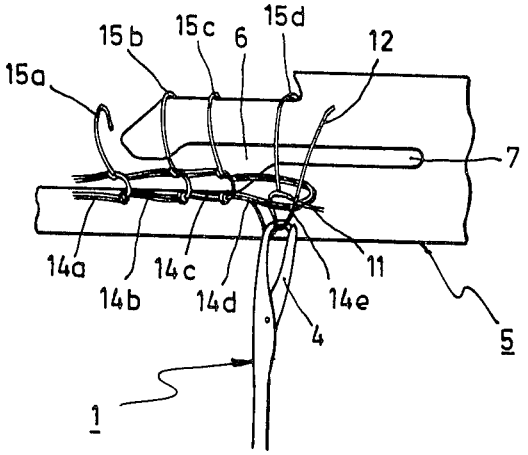

Then, as shown in FIG. 5, the needle 1 reaches its lowermost position to form a new stitch 14*e*.

Figure 6:
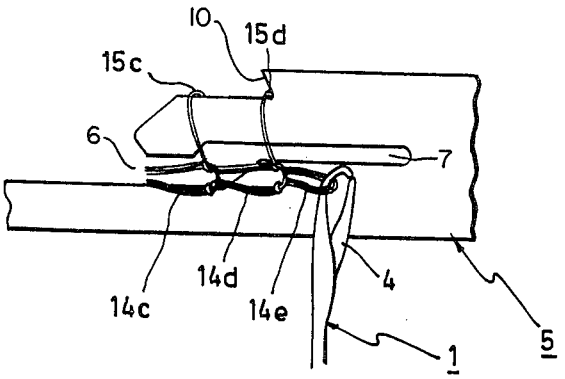

In the following stage, shown in FIG. 6, the needle 1 starts to rise while the sinker 5 continues moving forward to prevent stitch 14*d* from being rehooked by the needle.

Figure 7:
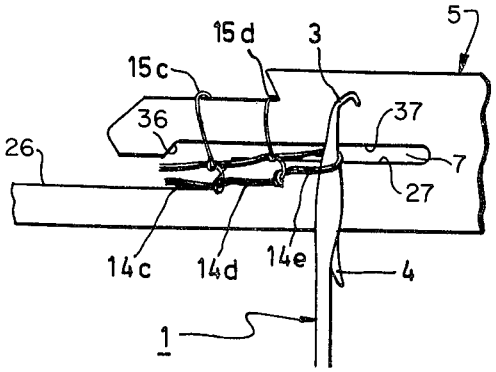
Figure 8:
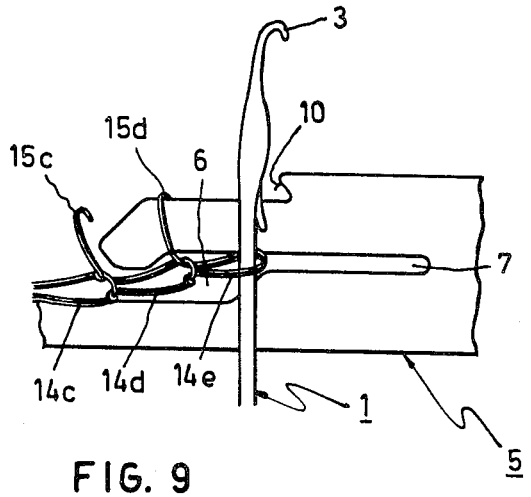

Then, as is seen in FIG. 7, the sinker 5 stops moving and the needle 1 reaches an intermediate position and, continuing upward, attains its uppermost position, as shown in FIG. 8, whereby the portions of stitches 15*a*, 15*b*, 15*c* and 15*d* superimposed over the base stitches have been stretched by their passage over the thickest portion of the needle 1 at the expense of the corresponding loop portion, while the base yarn stitches 14*a*, 14*b*, 14*c*, 14*d* and 14*e* recover their normal position on being pulled by the take-up beam.

Figure 9:
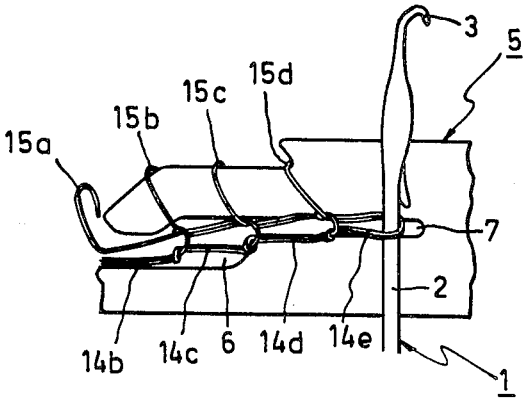

Thereafter, as shown in FIG. 9, the sinker 5 moves still further forward and pulls the pile loop of pile stitch 15*d* with the notch 10 until the stitch is tight around the stem 2 of the needle 1 and in the extension 7 of the throat 6, whereby that stitch recovers its normal dimension and, moreover, the stitch is prevented from passing over the latch and being rehooked by the needle in the drawdown movement.

Figure 10:
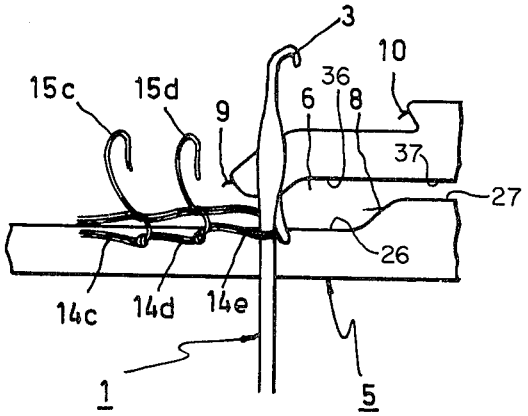

Finally, as shown in FIG. 10, in the last stage of the cycle, the sinker 5 is drawn backwards at the same time as the needle reaches an intermediate point, while the pile loops are released from the sinker.

The foregoing description discloses the advantages provided by the novel features of the invention to fabric knitting, according to the special features introduced by the sinkers 5, which may be stated as preventing rehooking of the pile stitches when the needle is drawn down and positioning the pile yarn correctly relative to the base yarn, so that the former is located further from the needle and the latter is inside closer to the needle.

What I claim is:

1. A sinker having a nib portion and a belly portion defining upper and lower yarn introduction levels, the said lower level including a yarn receiving throat and a horizontal extention thereto;

means associated with said nib portion to facilitate the reentry of said nib portion into previously formed pile loops;

further means associated with said nib portion to guide the path of a base yarn into the throat of the sinker;

still further means associated with an uppermost loop forming surface of the said nib portion for active engagement with previously formed pile loops to fully extend said loops and to reform them to loops of uniform pile height; and additional means associated with a loop forming surface of said belly portion of the sinker to facilitate the positive positioning of a base yarn relative to a pile yarn to insure a precise plating relationship between the said two yarns prior to and during stitch formation.

2. The structure as in claim 1, wherein said additional means for relative positioning of the base and pile yarns includes a shoulder connecting a lower edge of the throat and a lower edge of a throat extension.

3. The structure as in claim 2, wherein said further means for assisting the entry of the base yarn into the throat includes a bevel on the leading edge of an upper edge of said throat.

4. The structure as in claim 3, wherein said still further means to extend and reform previously formed pile loops to loops of uniform pile height includes a notch provided in the nib portion.

5. The structure as in claim 4, wherein said notch provided in the nib portion is approximately above the shoulder connecting the lower edge of the throat and the lower edge of the throat extension.

6. The structure as in claim 5, wherein said means to facilitate reentry of said nib portion into previously formed pile loops includes a downwardly extending surface on a leading extremity of said nib portion.

7. The structure as in claim 1, wherein said means to facilitate reentry of said nib portion into previously formed pile loops includes a downwardly extending surface on a leading extremity of said nib portion.

8. The structure as in claim 1, wherein said still further means to extend and reform previously formed pile loops to loops of uniform pile height includes a notch provided in the nib portion.

9. The structure as in claim 8, wherein said notch provided in the nib portion is approximately above the shoulder connecting the lower edge of the throat and the lower edge of the throat extension.

10. The structure as in claim 1, wherein said further means for assisting the entry of the base yarn into the throat includes a bevel on the leading edge of an upper edge of said throat.

* * * * *